US007147592B2

(12) United States Patent
Hinds et al.

(10) Patent No.: US 7,147,592 B2
(45) Date of Patent: Dec. 12, 2006

(54) RETAINED IMPINGER HANDGRIP ASSEMBLY

(76) Inventors: Robert Sylvester Hinds, 1803 Regent St., Madison, WI (US) 53703; Richard Michael Hegge, 3157 Muir Field Rd., Apt 35, Madison, WI (US) 53719; Loyd William Bonneville, 1213 Amsterdam Ave., Madison, WI (US) 53716

( * ) Notice: Subject to any disclaimer, the term of this patent is extended or adjusted under 35 U.S.C. 154(b) by 248 days.

(21) Appl. No.: 10/844,217

(22) Filed: May 12, 2004

(65) Prior Publication Data

US 2005/0255976 A1 Nov. 17, 2005

(51) Int. Cl.
*A63B 21/02* (2006.01)

(52) U.S. Cl. ..... 482/126; 482/44; 482/49

(58) Field of Classification Search ..... 482/126, 482/44–49, 907, 79; D21/662, 665, 682, D21/698

See application file for complete search history.

(56) References Cited

U.S. PATENT DOCUMENTS

| | | | | |
|---|---|---|---|---|
| 5,505,677 | A * | 4/1996 | Hinds | 482/10 |
| 5,549,532 | A * | 8/1996 | Kropp | 482/126 |
| 5,894,631 | A * | 4/1999 | Chiu | 16/110.1 |
| 6,398,698 | B1 | 6/2002 | Hinds | |
| 6,923,750 | B1 * | 8/2005 | Hinds | 482/126 |
| 6,988,978 | B1 * | 1/2006 | Nault et al. | 482/126 |

* cited by examiner

*Primary Examiner*—Lori Amerson
(74) *Attorney, Agent, or Firm*—Loyd W. Bonneville

(57) ABSTRACT

A handgrip is modified to have a tethering window cut through one of its upright prongs so that the stem of an impinger can be extended through it to anchor the impinger at the outside portion of the handgrip. Anchoring is accomplished either by the extension of the impinger's tether pegs into sockets or apertures or by trapping the tether within a channel formed there. Once anchored, the impinger's head is positioned within the handgrip's cord tunnel where it becomes forced against stretchable or non-stretchable exercise media including stretchable exercise sheet.

8 Claims, 7 Drawing Sheets

FIG 4
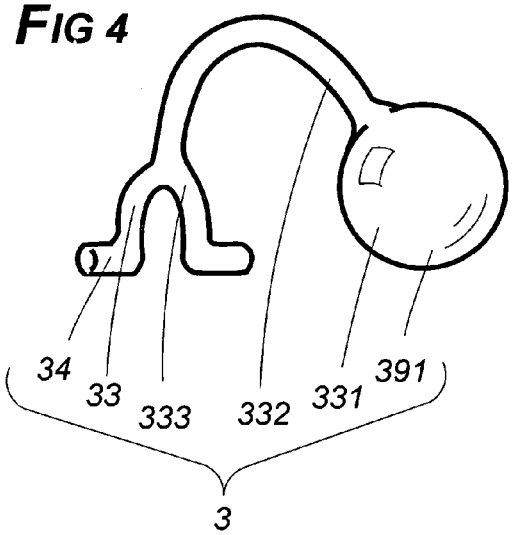
FIG 5
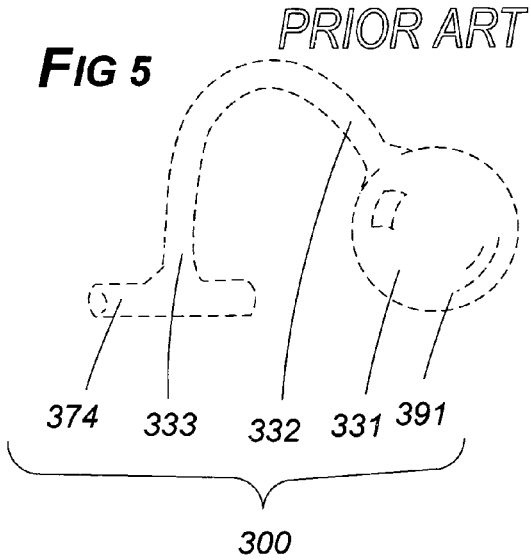
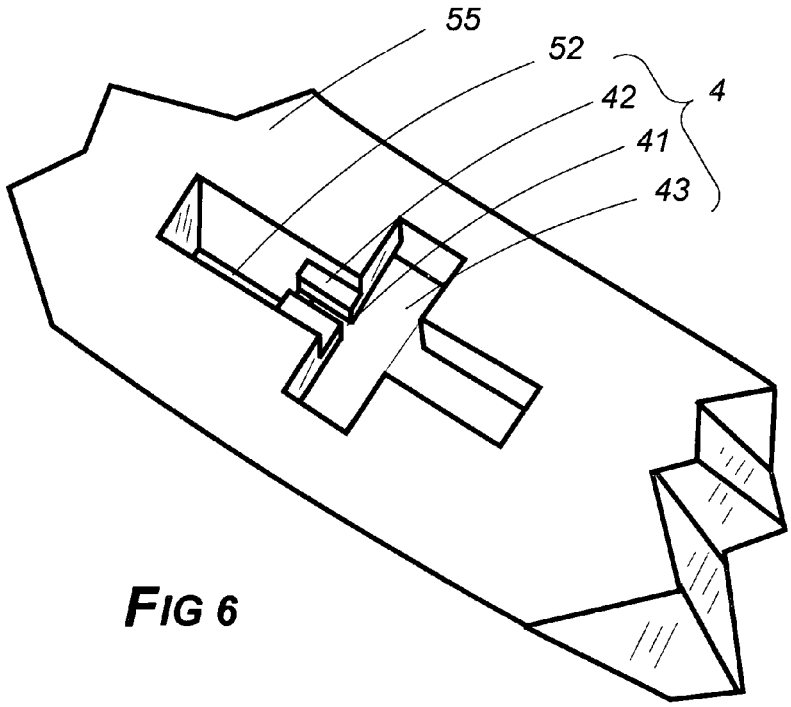
FIG 6

RETAINED IMPINGER HANDGRIP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Exercise Equipment

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term window's tether access opening (54) might be used in one instance but in another, if meaning is otherwise clear from context, expression might be shortened to tether access opening (54) or merely opening (54). Any of those forms is intended to convey the same meaning.

The term attach or fasten or any of their forms when so used means that the juncture is of a more or less permanent nature, such as might be accomplished by nails, screws, welds or adhesives. Thus it is stated herein that the connection of the impinger's head (331) to its stem (332) is one of attachment A connection in which an object is easily removed from another is described by the word emplace, as where it is stated herein that the impinger's head (331) is emplaced within the handgrip tunnel's nest (102). A connection in which two objects, although not attached could be separated only with considerable difficulty is referred to herein as one of rigid emplacement. The fastening of the impinger's pinchable tether (33) within the handgrip's transverse peg sockets (46) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that a prior art tunneled stirrup handgrip (100) is modified in certain particulars to comprise an impinger anchoring handgrip (1), meaning that the latter is in fact the former. The term comprise may also be characterized by what might be considered one-way equivalency, as when it is stated herein that a T-shaped configuration for the retention channel (41) preferably comprises its (41) tether anchoring means (4), meaning that in the given instance, the T-shaped channel (41) is itself (41) the tether anchoring means (4). This use of the word has a generic sense to it. That is, a T-shaped channel (41) will always be tether anchoring means (4) but tether anchoring means (4) may be a T-shaped channel (41) in one case but something else in another. However, the word comprise may also be used to describe a feature which is part of the structure or composition of a given object. Thus, an impinger anchoring handgrip (1) is said to preferably comprise, among other things, a tethering window (52) as a component thereof (1). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of an exercise handgrip (1, 100) or other object in the manner in which it would be typically oriented when held if the anchored tension point were situated at the bottom and as presented in the drawings. Thus, the tethering window (52) is described as passing through some portion of the handgrip's upward extensions; the effect of gravity upon the impinger (300) is explained in terms of the handgrip's tunnel (101) being disposed downward; and the tether (333) of a traditional impinger (300) as extending outward from the lower end of the cord tunnel (101). It is intended that orientational references to the object be equally understood regardless of any theoretical disposition of it such as, for example, if it were held upside down.

By definition herein, the term "in communication with" concerning the interrelationship between two objects means that nothing is disposed to separate or provide a barrier or other obstruction of the like between them. Where, for example, channels and openings are considered to be in communication with one another, what is meant is that the cavities disposed by each are coextensive with one another much in the way a river and the reservoir of water supplying it are in communication with each other. And, where it is, thus, said as herein that the retention channel (41) is in communication with the tethering window (52), what is meant is that the two structures (41, 52) extend directly into one another without structural impediment. The phrase communicative alignment is addressed ante.

Wherever practicable, words and phrases are presented in adjective form with reference to a given object to describe either its function or its essence. Thus, a retention configured impinger (300) has been known merely to designate one (300) configured for retention.

The term reeve, or any of various forms thereof, is occasionally employed herein. It is stated, for example, that in certain embodiments, the impinger stem (332) and tether (333) may operably be reeved through the handgrip's window (52).

In some cases, the same word expressed as a noun is also used for a verb. Thus, it is stated, for example, that the handgrip (1) comprises the cord tunnel (101), the opening through which the exercise media member (200) passes. Yet, it is also said that prior art handgrip (100) employed for modification must be tunneled. The propriety of this divergent use of the term is established by the dictionary.

In that respect, certain other words may also occasionally be coined herein to simplify discussion by interchanging noun, verb or adjective or by modifying certain words. It takes little imagination to understand, for example, that the coined word impinger (300), often itself the center of discussion herein, has been recognized as identifying an object which is capable of impingement upon another object. The word rotable is another example of coining use denoting a spinning behavior rather than some other sort of circular motion which might be addressed by the more cumbersome word rotatable.

References to the general exercise media member (200) are meant to include the specific stretchable exercise cord (201); stretchable exercise strap (202); stretchable exercise sheet (203); rope (204), whether hemp or other; fabric strapping (205); and solid flexible cord (206), such as plastic and the like. The term cord tunnel (101), used as a matter of convenience herein, is not intended to limit application to the reeving of stretchable exercise cord (201) therethrough but to extend also to that of stretchable exercise strap (202), stretchable exercise sheet (203) as well as the non-stretchable media.

Because of the feasibility of incorporating into the assembly addressed herein either a prior art impinger (300) or the improved one provided for herein (3) comprising a departure therefrom, for the sake of convenience and to avoid unnecessary cluttering, reference numbers are occasionally recited in the compound sense—for example, (3, 300) with reference to the impingers themselves; or (34, 374) with reference to specific types of impinger tethers. As a convenient convention to clarify the distinction, the prior art varieties or components are identified to have three digits.

The tunneled stirrup handgrip (100) and impinger (300) combination have, for a time now, become established in the prior art. Traditional plugged stretchable hollow exercise cords (201)—those in which a plug is fitted within the cord's (201) end after insertion through a handgrip's cord tunnel (101)—demonstrate considerable wearing of the cord (201) because of its (201) contact against the upper edge of the handgrip's cord tunnel (101). It was to that end the impinger (300) was developed. A length of exercise media member (200), usually a stretchable—or "elastic" as sometimes expressed—is passed through the tunnel (101) of a traditional prior art handgrip (100). Its (200) length is adjusted by pushing more or less of it (200) through the opening (101). Having now been selectively positioned for length, an impinger (300) is then pulled against it (200) into the tunnel's upper portion—or nest (102), as it is designated, so that it (200) becomes rigidly emplaced therein (102). By reason of the combination's use, an operator may quickly change the effectual length of the media member (200) or interchange it (200) with another.

In addition to the tunnel (101), the handgrip (100) comprised upward extending prongs and, at the uppermost extremes thereof, a handhold (103) configured to be either fixed or rotable.

The exterior sector (105) of the traditional handgrip (100) is that portion thereof (100) outside that into which the operator's hand—or, in some instances, his or her foot—extends. That latter portion of the grip (100)—inside—is herein designated its interior sector (106).

The impinger has always comprised a head (331), a stem (332) and a tether (333). The head (331) has been attached to one end of the stem (332), the tether (333), to the other. It is the head (331) which trapped or snugged against the media member (200) during impingement. The tether (333) at the opposing end performed no impingement function but has been intended merely to secure the impinger (300) to the handgrip (100). Since the impinger (300) has been stationed at the handgrip tunnel (101) with the head at the top thereof (101) at the grip's interior sector (106) and the tether (333) at the bottom thereof (101) at the exterior sector (105), the connecting stem (332) has necessarily resided within it (101).

Schemes for handgrip impinger (300) to exercise media (200), primarily stretchable exercise cord (201) have taken various forms as shown in U.S. Pat. No. 5,505,677 issued to Hinds, also the applicant herein; U.S. Pat. No. 5,549,532 issued to Kropp; U.S. Pat. No. 5,894,631 issued to Chiu; and U.S. Pat. No. 6,398,698 issued to Hinds. The impinging heads themselves (331) have been offered in various shapes, some more suitable than others in fulfilling their (333) purpose. In the latter Hinds patent, several configurations were provided including spherical (391), lozenge (392), truncated sphere (393), ovate (394) and bean shape (395). One of the embodiments of the impinger's tether (333)—that is, the anchoring portion—comprised transverse extensions (373), a widely adopted configuration.

During media member (200) impingement, the stem (332) crowded it (200) to some extent interfering with impingement. When not in use, the impinger (300) was subject to possible loss or misplacement because the same characteristics which permitted its (300) emplacement could also be responsible for its (300) dislodgement. Worse, a phenomenon known as torque stress was often observed in which the impinger's head (331) twisted as the exercise cord was pulled in one direction or another. Because the stem (332) was not anchored, there was no way to avoid the problem.

Even should a suitable anchoring solution be conceived, however, some additional change to the impinger (300) must be made to avoid the hindrance to the impinger head's (331) emplacement within the impingement nest (102) caused by its (331) side-to-side swaying at the end of a stem (332) to date having been made slender enough to be seated within the cord tunnel (101).

It is now recognized that what is needed is an impinger (300) whose stem (332) could be disposed other than through the cord tunnel (101) so that it (332) not only could be disposed for more dependable association with the handgrip (100)—separated from it (100) only with difficulty—but more importantly, might be successfully strengthened in rigidity to address both the torque stress and the side-to-side swaying, features of axial stability.

The problem of stretchable cord (201) abrasion against the upper edge of the handgrip's tunnel (101) still remains despite the use of the traditional impinger (300). A new arrangement permitting removal of the stem (332) from the tunnel (101) would circumvent those difficulties. Even the scheme of wrapping the stem (332) around one of the handgrip's (100) prongs and then clamped in some fashion, although meritworthy, have not been completely satisfactory. A connection of that sort can still become loosened and thereby hinder exercise.

Exercise operators have also experienced difficulty in having stretchable exercise sheet (203) comprise the media member used with the handgrip (100) because it (203) cannot be easily reeved or pushed through the cord tunnel (101). This is particularly important in matters of rehabilitation. It would be helpful if impingers (300), designed rather small to avoid obstructive interference during use, could be provided to allow widening of the tunnel (101). Those steps would provide a beneficial solution to that problem.

It would also be useful if impingement could be imposed against a greater class of exercise media members. Impingers (300) which work well with stretchable exercise cord (201) have been observed to fail miserably with non-stretchable media such as rope (204), fabric strapping (205) or solid cord (206% say, the one-eighth to one-quarter inch diameter sort sometimes preferred in certain exercises. A more or less universal impinger (300) configured to provide the capability of retaining well any media flexible enough to become impinged-even the non-stretchable materials—would be welcome.

The historical development went far, at least to a point, in addressing important needs and objectives related to exercise handgrip (100) use. It is now time, however, to address needs and objectives emanating from the fruits of those past efforts.

BRIEF SUMMARY OF THE INVENTION

The invention comprises a modification of a prior art handgrip (100) and in some cases, the familiar retention configured impinger (300) to comprise an impinger anchoring handgrip (1) and pinch-tethered impinger (3). The improved handgrip (100) then incorporates or firmly anchors the tether (33, 333) securely, disposes the impinger's stem (332) at a site outside of the handgrip tunnel (101) and stiffens it (332) to axially stabilize the impinger's head (331) and facilitate its (331) emplacement within the cord tunnel's impingement nest (102). The stabilization feature avoids stress torque and the side-to-side stem (332) swaying propensities otherwise present.

To that end, in the most preferred embodiments, a tethering window (52) with a tether access opening (54) therein is disposed in one of the upwardly extending prongs of the modified handgrip (1) and transverse peg sockets (46) or peg apertures (47), within which (46, 47) impinger tethers (333) are rigidly emplaced, disposed at the handgrip's exterior sector (105) within the body of the handgrip (1), preferably within an ensconcing hollow (55).

In some embodiments, a retention channel (41)—often additionally comprising a tether access opening (43)—is disposed at the handgrip's exterior sector (105). The channel (41) comprises a stem slotted roof (42) which entraps the impinger's tether (333) but allows the stem (332) and tether (333) to move freely along the length thereof (41).

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

FIGS. 4 and 5 respectively illustrate the pinch-tethered impinger (3) and that (300) comprising the rod-shaped extension (374), the latter, again, a product of the prior art. Given appropriately disposed peg sockets or apertures (46, 47, respectively), as the case requires, the tethers (33, 333) of both (3, 300) can be observed to comprise snap-in anchoring capabilities.

FIGS. 6–8 are cut-away depictions of the ensconcing hollow (55) in embodiments in which the handgrip's tether anchoring means (4) comprises a retention channel (41) disposed at the handgrip's exterior sector (105). A stem slotted roof (42), serving to trap the tether (33, 333) in retention, overlies the channel (41). The window (52) in these embodiments is formed without a tether access opening (54). Such an opening (43) is instead disposed within the newly added retention channel (41). In this arrangement, the snap-fitting of the pegs or rod-like tether members (34, 374) through the access opening (43) rigidly emplaces it (34, 374) within the channel (41) at the exterior sector (105). Although the channel (41) and window (52) of FIG. 6 are in communication with one another (41, 52), those of FIGS. 7 and 8 are not. They (41, 52) are instead shown to be slightly separated. FIG. 8, comprising a T-shape for the tether access opening (43), illustrates the tether's (33, 333) disposition during use.

In FIG. 13 is shown an ovate head (394) impinged against an exercise media member (200) comprising fabric strapping (205). In FIG. 14, a lozenge shaped head (392) impinges against a media member of rope (204); in FIG. 15, truncated sphere (393) against solid cord (206); and in FIG. 16, bean shaped (395) against stretchable exercise strap (202).

DETAILED DESCRIPTION OF THE INVENTION

Figure 1:
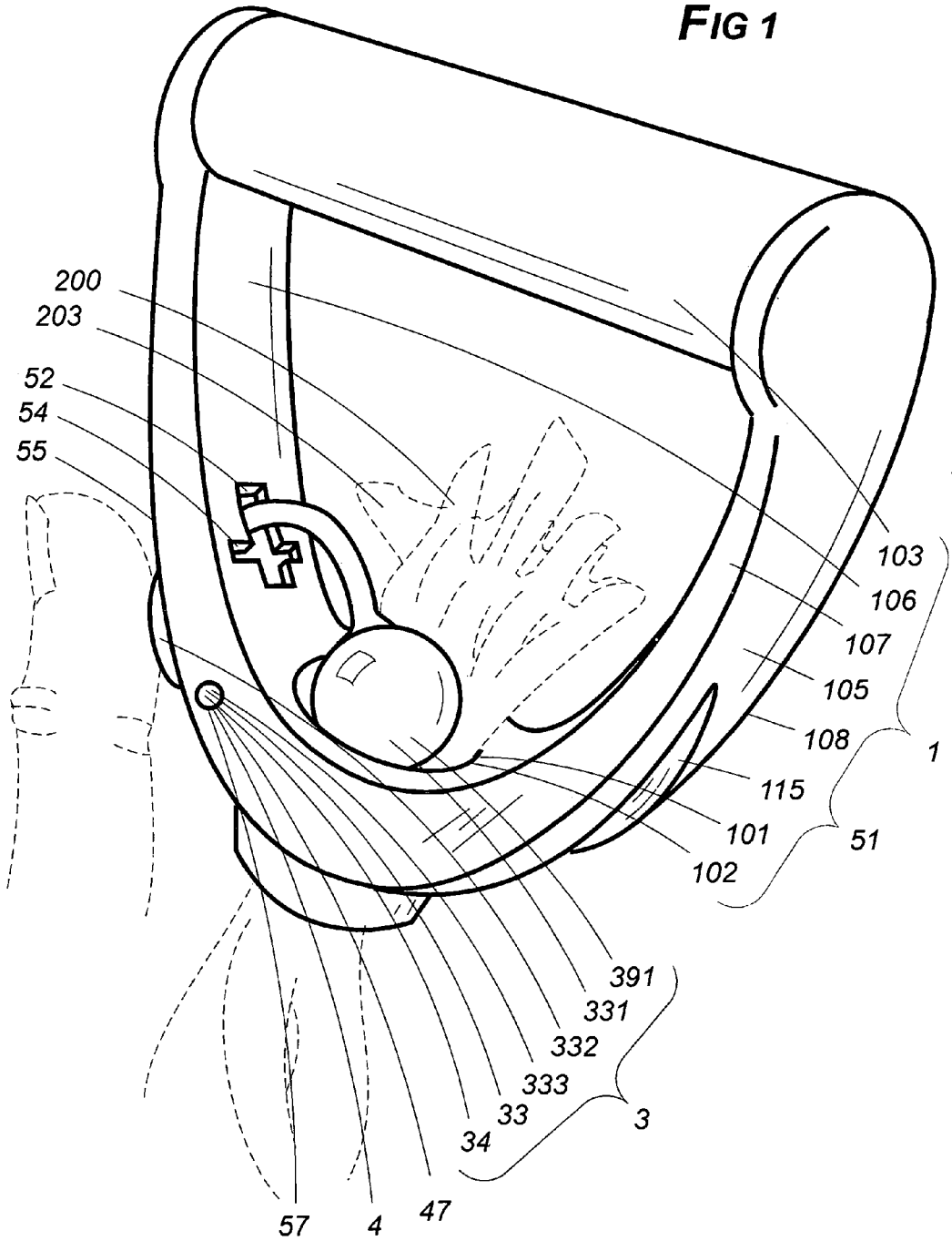
FIGS. 1 and 2 represent an embodiment of the assembly in perspective illustrating an impinger's (3) impingement in FIG. 1 of a stretchable exercise sheet (203) and, in FIG. 2, of a stretchable exercise cord (201). Although the tether (333) is mostly hidden from view in the first of these renderings, the latter confirms that the impinger (3) comprises the proposed pinch tethered configuration which is disclosed and not the familiar one (300) comprising the traditional rod-shaped tether (374) of prior art. The handgrip's tether anchoring means (4) is shown to comprise opposing transverse peg apertures (47)—merely a hole penetrating the body of the tunneled stirrup handgrip hereof (1), beginning at its face (107) and exiting at its reverse side (108). The tether access opening (54) is also disposed in this preferred configuration to pass completely through the handgrip (1) but in this case from its interior sector (106) to an ensconcing hollow (55) at its exterior sector (105).
Figure 2:
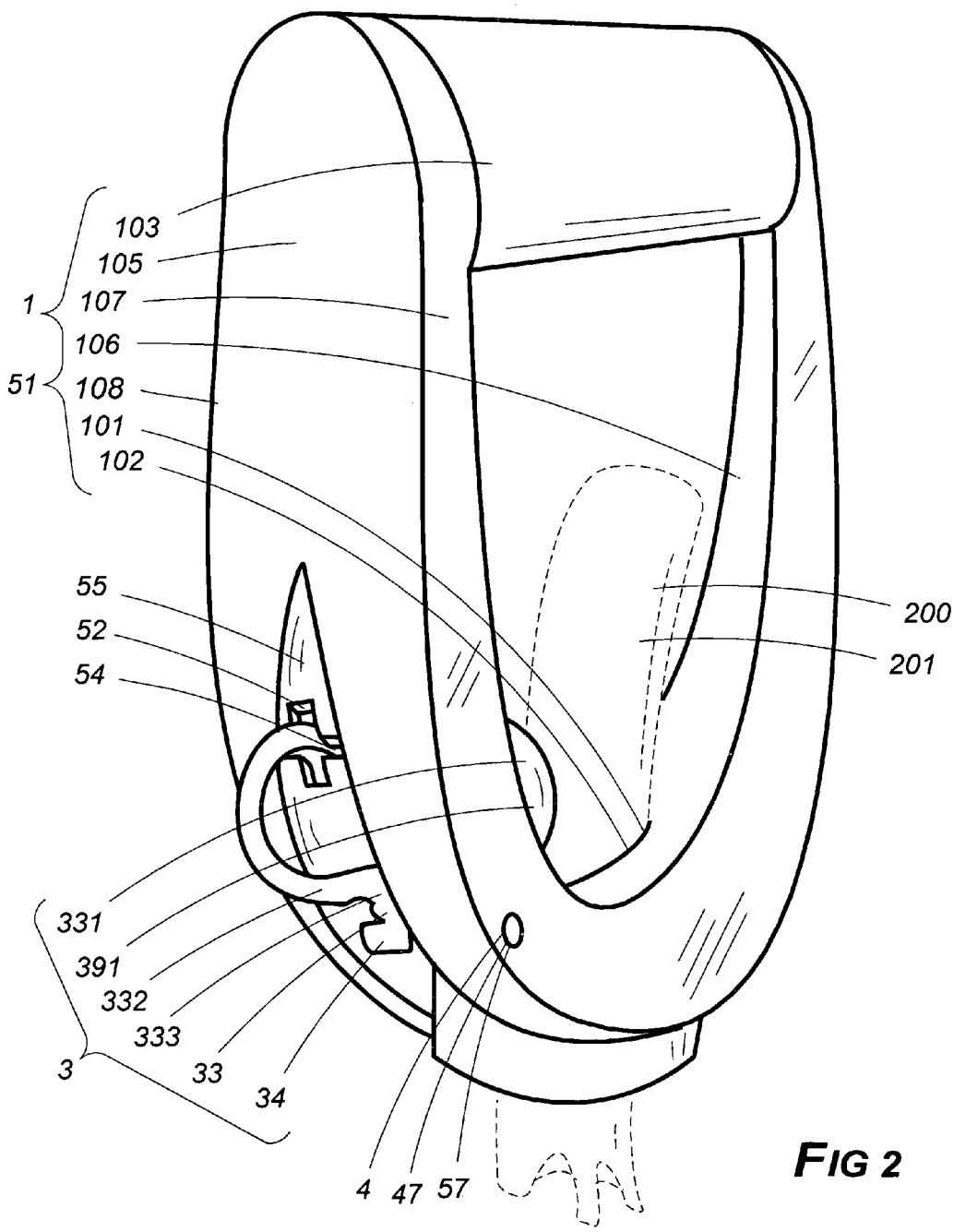
Figure 3:
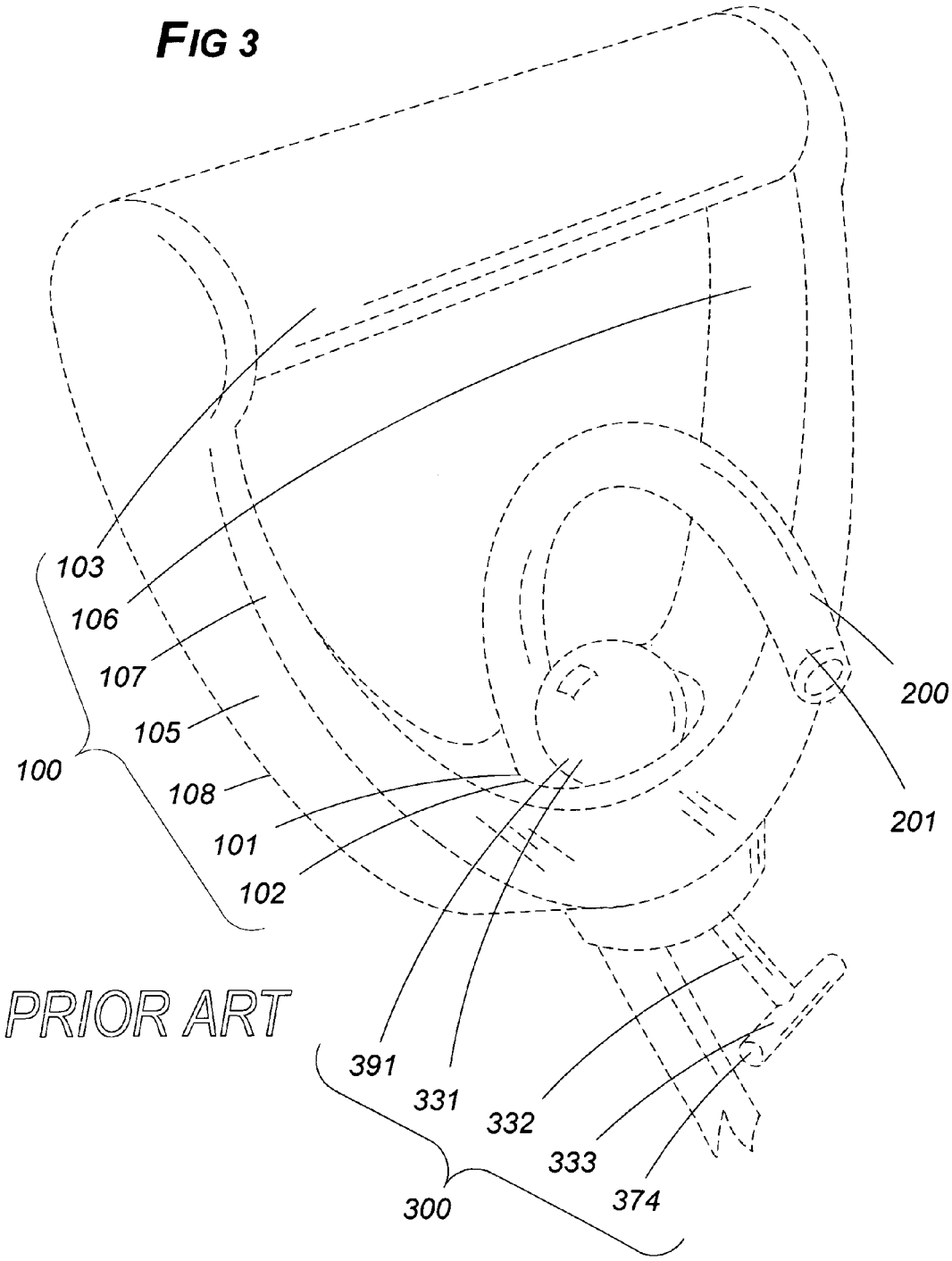
FIG. 3 portrays the tunneled stirrup handgrip (100) of prior art wherein the more familiar retention configured impinger (300) shown with the stem passing through the tunnel (101) comprises the well known rod-like transverse extension (374).
Figure 7:
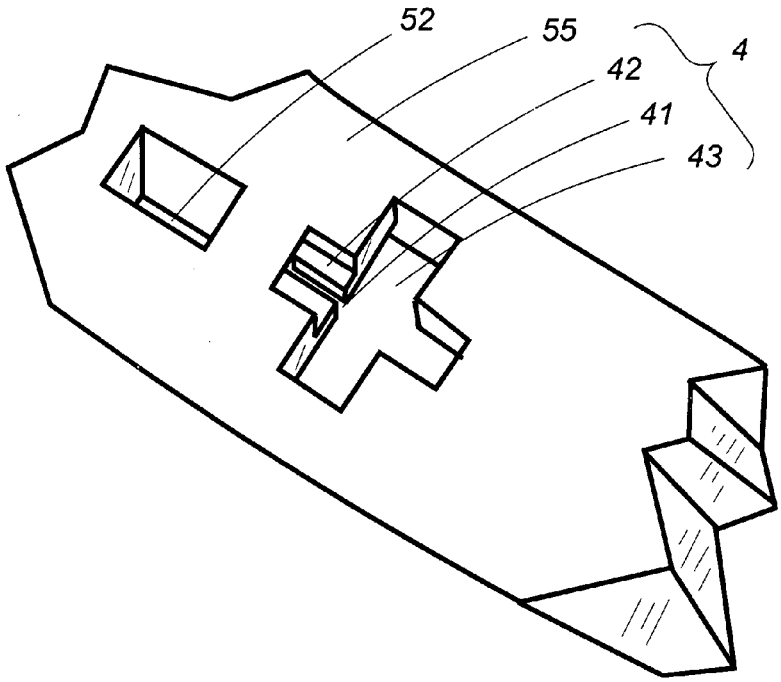
Figure 8:
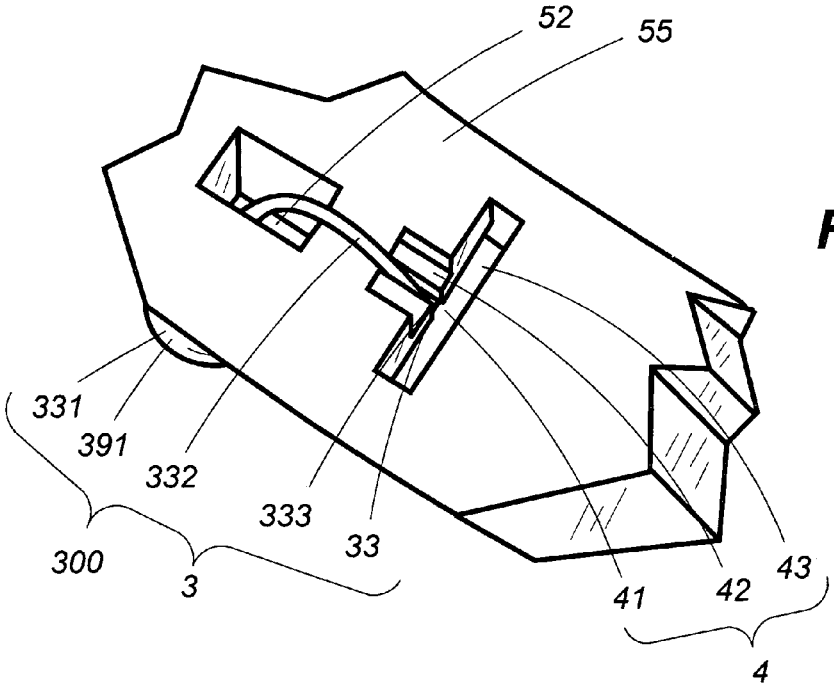
Figure 9:
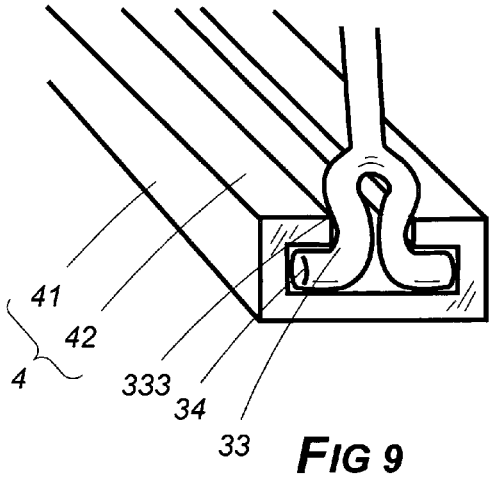
FIGS. 9 and 10 provide tether (33, 333) and channel (41) examples of peg or rod-like extension (34, 374) and transverse socket or aperture (46, 47) connective relationships. The first of those drawings illustrates the seating of its pegs (34) of the pinchable tether (33); the second thereof, the usual rod-like extensions (374) of the prior art model (333).
Figure 10:
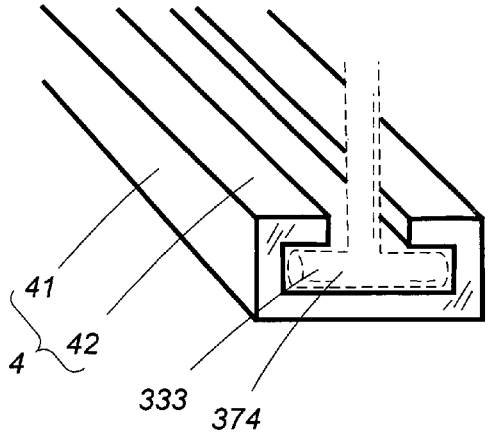
Figure 11:
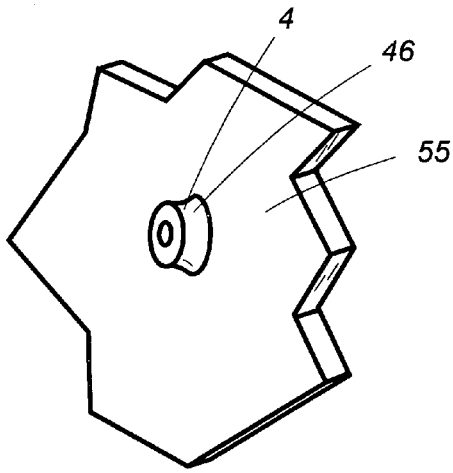
FIGS. 11 and 12 are cut-away portions within the ensconcing hollow (55) of tether anchoring means (4). The first of these displays a transverse peg socket (46); the second, a transverse peg aperture (47).
Figure 12:
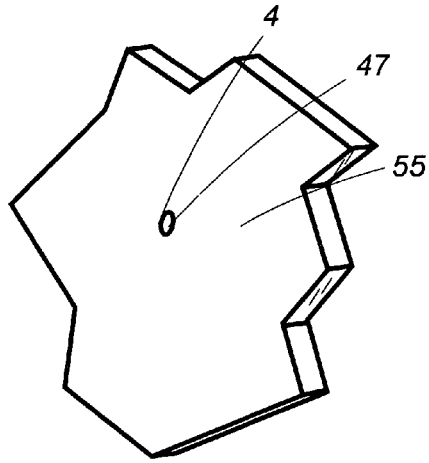
Figure 13:
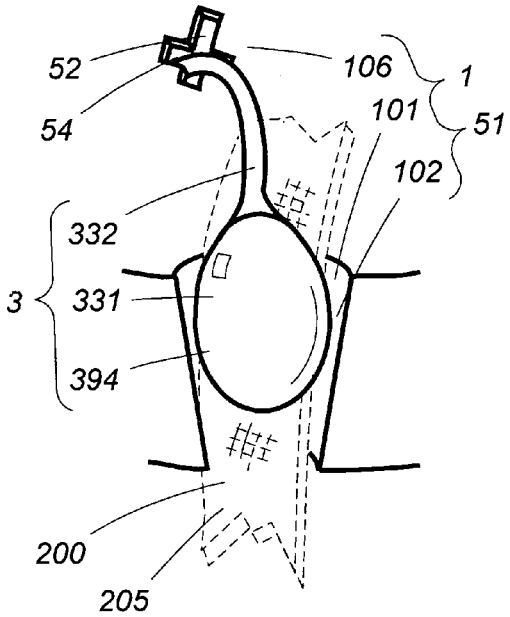
FIGS. 13–16 are cut-away views of various configurations of impinger heads (331).
Figure 14:
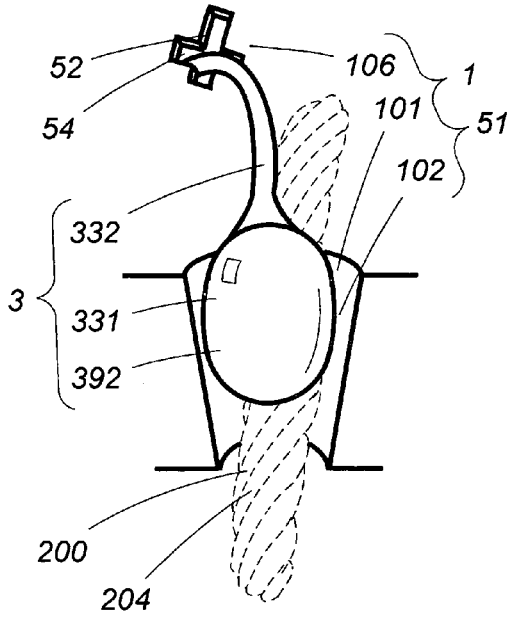
Figure 15:
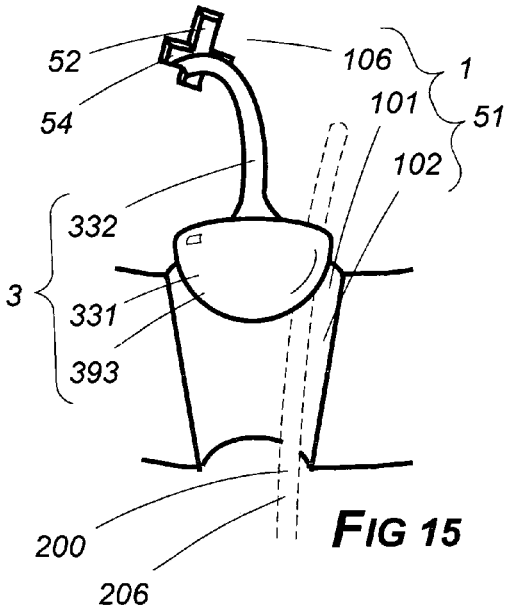
Figure 16:
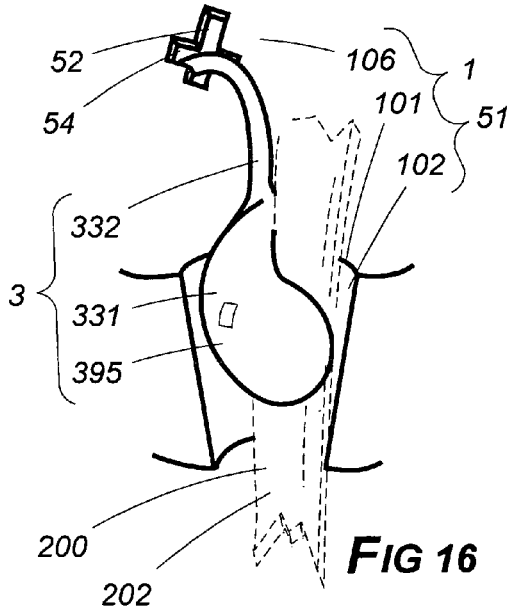

The subject of this application is an assembly comprising in the main two well known components, one of them modified extensively to comprise different embodiments, the other, modified only optionally in minor respects. To this end, the tunneled stirrup handgrip of prior art (100) is modified in certain particulars to comprise what is referred to in the generic sense herein as an impinger anchoring handgrip (1) which permits the anchored connection of an impinger either of the prior art variety (300) or the one provided anew herein (3). The connection can then be made in a manner which renders the handgrip's cord tunnel (101) unobstructed by any portions of the impinger's stem (332) or tether, whether one known in general to prior art (333) or the one provided for herein as an improvement (33).

The impinger's head (331) may be configured in any one of a number of ways. While any of the prior art shapes comprising a circular cross-section will work satisfactorily, the spherical (391) is preferred.

By definition herein, the phrase impinger anchoring used as an adjective with reference to the handgrip (1) means that its (1) structure is such as to provide an anchoring niche, appendage or other holding structure wherein the impinger's tether (33, 333), supra, is retained in a manner which enhances use of the combination in the respects addressed herein.

As its name suggests, exterior sector anchoring type of handgrip (51) comprises one in which the impinger (3, 300) is anchored at the handgrip's exterior sector (105).

The exterior sector anchoring handgrip (51) comprises a tethering window (52) preferably configured as a slot passing through some portion of one of the grip's (51) prongs or upward extensions. In assembly for use, the impinger's stem (332) extends through the window (52), disposing its tether (333) at the grip's exterior sector (105) and its head (331) within the grip's interior one (106). The structural relationships—the stem's (332) length and window's (52) proximity—allows the head (331) to reach the handgrip's impingement nest (102) within the cord tunnel (101).

Where anchoring comprises nothing more than disposing the tether (333) at the handgrip's exterior sector in such fashion that when tugged, it (333) is drawn against the window (52) to accomplish its (333) purpose and, perhaps, avoid loss, it (333) must comprise size sufficient to prevent its being drawn through the window (52). In this simple arrangement, the head (331), unfortunately, is in no way restrained from side-to-side swaying, stress torque when in use or from other unwanted movement even though so anchored by the tether (333). Despite the simplicity of this arrangement, the tether (333) may, nevertheless, be considered to comprise what is stated herein as tether retention means and the handgrip (51) to comprise tether anchoring means (4). However, other more preferable embodiments dedicated to those concerns are provided for herein, ante.

The popular rod-like transverse extension (374) model of tether (333) may be acceptably employed in the assembly. Of the impingers (300) presently known, one (300) comprising a flexible stem (332) would facilitate manipulation for the tether's (333) operational reeving through the window (52) along with the stem (332). However, to address the issues of movement constraint just alluded to, experience dictates advantage and, accordingly, a preference first, by configuring the stem (332) and tether (333) to comprise what is defined herein as relative rigidity, wherein little or no bending is permitted to occur; second, by securely anchoring the tether (333), ante; and third, by disposing the handgrip's anchoring means (4), the tethering window (52), and the handgrip's impingement nest (102) in communicative alignment with one another-defined to mean herein that the three (4, 52, 102) are disposed in a fairly straight line.

The exterior sector anchoring handgrip (51) comprises tether anchoring means (4) disposed at the exterior sector (105) upon one of the handgrip's (51) prongs. If a tether access opening (54) is disposed in the window (52), comprising a cutout of either T-shaped or cross-like configuration, either the lateral extension of the rod-like tether (374) or the pegs (34) of the pinchable tether (33) may be pushed through it (54). Once that has been done, the tether (333, 33) may be considered securely retained at the handgrip's exterior sector (105) exemplifying acceptable anchoring means (4). If there is provided thereat an ensconcing hollow (15)—a carved out portion of the exterior sector (105)—the tether (33, 333) will likely be open to view only upon very close scrutiny, depending mainly upon the hollow's (15) design. Tethers (33, 333) comprising either the traditional rod-like transverse extensions (374) or the pegs (34) for the pinchable tether (33) are herein defined to comprise retention means and alternatively described as those configured for retention or as comprising impinger retention means or as retention configured tethers (33, 333).

In this construction, as shown in FIG. 1, the operator may conveniently push the impinger (3, 300) into the handgrip's impingement nest (102) with his or her thumb, the projecting stem (332) behaving much like a trigger. It is the degree of (3, 300) rigidity conferred upon the impinger (3, 300) which makes this feasible. Moreover, because of the removal of the impinger's stem (332) from it (101), the handgrip's tunnel (101) may be configured with greater diameter, enhancing the use of stretchable exercise sheet (203) as the media member (200), to meet that problem, supra.

In these arrangements, it is generally contemplated that a tether's (33, 333) retention is accomplished during manufacture. Techniques are even known, though not perhaps preferred, by which the tether (33, 333) could be factored within the assembly in a manner suggestive of the well known ship-in-a-bottle exhibit. However, were the two members of the assembly—the specially configured handgrip (1) and the impinger (3, 300)—separately provided, they (1;3, 300) can be operably snapped together in preparation for exercise if suitable allowances are made for doing so.

In the event the tether (33, 333) comprises configuration of a different sort wherein pegs (34) or lateral extensions are absent, the tether access opening (54) should be configured to accommodate its (33, 333) narrowest dimension.

However, it is highly advantageous to incorporate the rod-like structures of the prior art (374) or those of opposing peg configuration provided for herein (34) because they (374, 34, respectively) may be fitted into transverse peg sockets (46) or transverse peg apertures (47). As the name suggests, the peg sockets (46) are receptacles disposed in opposition within the body of the handgrip (51) or upon the interior walls of the ensconcing hollow (55), if present, so that the pegged or rodded portions (34, 374) of the tether structures (33, 333) are rotably seated within them (46). So disposed, the inserted pegs (34) are free to pivot but by reason of the tether's (33, 333) configuration, are retained securely in place much as a vehicle's axle would be within its housing. Peg apertures (47), if present in substitution for the sockets (46) function in the same manner as them (46). As a convenience in manufacture, the apertures (47) may be drilled—or tunneled—completely through the body of this type of handgrip (51). Although apertures (47) are employed, a socket-like buildup around them (47) within the hollow (55) may be provided such that retention of the pegs (34) or extensions (374) is reinforced.

The rod-like transverse extensions (374), when comprised by the prior art tether (333) have been observed to provide enough flexibility to permit their (374) being forced into place. Preferably, however, the assembly hereof comprises a pinchable tether (33) as tether retention means or tether retention configuration. The pinchable tether (33) is particularly well suited to both installation and retention in that the open extensions of its U-shape may be pinched together and then released to slip the pegged ends (34) through the tethering window (52), through any retention channel (41) present and fit into place within the transverse peg sockets (46) or apertures (47). Experience suggests a preference in tapering the walls of the window (52) such that they are wider at the interior sector (106) than at the exterior one (105). Such configuration enhances enreevement of the tether (33, 333) therethrough (52). The pinchable tether's (33) installation is also benefitted by the preferred communicative alignment described supra. The connection is an appropriate example of rigid emplacement as defined herein, supra. It is for all these reasons these pegged (34) or rodded (374) structures are preferred embodiments of tether (331) design and sockets (46) and apertures (47), preferred tether anchoring means (4).

In a different embodiment, this type of handgrip (51) further comprises a retention channel (41)—a trench configured with tether anchoring means (4)—disposed upon one of the windowed handgrip (51) prongs at the exterior sector (105) and proximate the window (52). One of such anchoring means (4) is made feasible by narrowing a portion of the channel (41) so that the tether (333) becomes wedged within it (41) when tugged. Preferably, however, where the impinger (3, 300) comprises opposing pegs (34) or a rod-like tether (374), the channel itself (41) is formed to comprise the required tether anchoring means (4). To that end, it (41) comprises a stem slotted roof (42), disposing the cross-sectional opening into a generalized inverted T-shape, resembling the well known strain relief provided on some electronic equipment to keep an electric cord from pulling loose. This inverted T-shaped configuration—the manner in which the channel (41) is widened beneath the stem-slotted roof (42)—should not be confused with the optional T-shaped perimeter of either of the access openings (43, 54), a configuration substituted for the cross-like one and apparent when looking directly at the surface.

In this channeled embodiment, the pegged (34) or rod-like (374) portions of the tether (33, 333) are permitted to slide freely along the channel (41) beneath its roof (42), but cannot easily be removed from this captive enclosure. As with their seating in the socketed (46) or apertured (47) constructions, they (34, 374), again, are appropriately said to be rigidly emplaced. As suggested, supra, the slotted roof (42), when present, preferably comprises the tether access opening (43) similarly designed to that (54) which is a feature of the window (52).

In these arrangements, the channel (41) and window (52) are preferably disposed in communication with one another (41, 52), since such configuration permits the stem (332) to seat more completely within the channel (41) without outward projection during impingement.

In all of the exterior sectored anchoring schemes, as preferentially indicated, supra, the tether anchoring means (4), the tethering window (52) and the tunnel's impingement nest (102) are preferably disposed, of course, in communicative alignment. However, even more than that is required to insure maximum operability.

The center of the impinger head's (331) horizontal cross-section—that is, the circular cross-section one would observe if peering downward through the handgrip's tunnel (101) at it (331) seated at the nest (102) therein (101)—is preferably disposed or aligned with the longitudinal center of the tunnel itself (101), in disposition of what is herein defined as radially centered alignment. Now, as the head (331) is moved from its (331) dormant non-impinging position to its (331) fully impinging one, it (331) traces out or describes a circularly arcuate path of descent. The tether anchoring means (4), whether the point of restraint within a retention channel (41) or the horizontally disposed axial center of the transversely disposed tethering means (34, 374), thus, occupies the circle's center in this preferable arrangement. Should those points be off-center, it is likely the impinger's head (331), extending from a reasonably stem (332) comprising little flexibility, would butt up against the sides of the vertically disposed handgrip tunnel (101) as it (331) moves either upwards or downwards therethrough (101).

Moreover, even having assured the presence of radially centered alignment, supra. It is, therefore, further preferable to provide a handgrip tunnel (101) which is wider at the top thereof (101) than at the bottom or—in any event—than the impingement nest (102).

In considering these preferential steps, a further measure should also be taken: The axial center of the transversely disposed extensions (374) or pegs (34) should be in approximate horizontal alignment with the point of impingement—that is, the point at which the impinger's head (331) has reached full impingement of any exercise media (200) present or, if none is present, the point at which it (331) fully engages the impingement nest (102) within the tunnel (101). This disposition of tether (333) and head (331) is herein described as horizontally aligned head to tether centering. If out of such preferred horizontal alignment, the impinger head's (331) arcuate path would again likely bring it (331) in contact with the tunnel's (101) wall, impeding impingement or contributing to potential impinger head (331) or tunnel (100) abrasion.

The issues of side-to-side swaying, stress torque and other divergent movements of the impinger's head (331) mentioned supra, are addressed in either of the exterior sector anchoring handgrip (51) embodiments hereof in two general ways. First, the impinger's tether (33, 373) is securely anchored. Second, the composition of the improved impinger (3) herein or its prior art predecessor (300) must be such as to comprise either of them (3, 300) with considerable stiffness—a property herein designated as relative rigidity. Thus, both a prior art impinger (300) having a stem (332) comprising that property and the improved impinger hereof (3), which is required to comprise it, are thereby distinguished from the less preferred prior art impinger (300) comprising flexibility depriving it (300) of that quality. The steps taken to address tether (33, 333) security and impinger (3, 300) composition—the two measures addressed supra—provide a property herein defined as axial stability.

Preferably, then, in adoption of the exterior sector anchoring handgrip (51), whether the tether anchoring means (4) is accomplished by disposing members of the impinger (3, 300) into sockets (46) or apertures (47), or whether into a retention channel (41), the impinger's stem (332) is made to comprise composition providing it (332) relative rigidity and curved configuration so that it (332) is disposed to extend upward and through the window (52), then to curve back upon itself (332). During impingement—that is, when the head (331) is seated against the exercise media member (200) within the tunnel nest (102), the stem (332) is disposed to pass through the window (52) without contact between them (52, 332). When during non-impingement, the handgrip (51) is held so that its tunnel (101) is disposed downward, the impinger (33, 333) is drawn out of the way by gravity.

The exterior anchoring handgrip (51) preferably comprises a further useful modification. It (51) may have carved into its exterior sector (105) the ensconcing hollow (55) referred to supra—a shaped cavity wherein the impinger anchoring means (4) are embedded in a manner which removes them (4) substantially from view, streamlining the handgrip's (51) shape for both functional and aesthetic reasons.

The invention claimed is:

1. An adjustable exercise handgrip assembly comprising:

an impinger for an exercise media member; and an impinger anchoring handgrip;

the impinger comprising a head;

a stem; and a tether configured for impinger retention;

the handgrip comprising a tethering window; and tether anchoring means;

wherein the tether is disposed for retention with the stem extending through the tethering window such that the exercise media member's impingement by the head is not subjected to compromise by reason of obstructive presence of the stem or tether within the handgrip's tunnel.

2. The adjustable exercise handgrip assembly according to claim 1 wherein the impinger comprises pinch-tethered configuration in turn comprising pegs for impinger retention.

3. The adjustable exercise handgrip assembly according to claim 1 wherein the handgrip's tether anchoring means comprises transverse peg apertures.

4. The adjustable exercise handgrip assembly according to claim 1 wherein the handgrip's tether anchoring means comprises a retention channel disposed at the handgrip's exterior sector.

5. The adjustable exercise handgrip assembly according to claim 1 wherein the handgrip comprises an ensconcing hollow disposed at the exterior sector thereof wherein the impinger's tether is anchored to enhance the assembly's use.

6. The adjustable exercise handgrip assembly according to claim 1 wherein the impinger's head, impinger's stem and the handgrip's tunnel are disposed in communicative alignment;

the impinger's head and handgrip's tunnel are disposed in radially centered alignment;

the impinger comprises horizontally aligned head to tether centering; and the impinger's stem is configured to comprise relative rigidity providing the impinger axial stability.

7. The adjustable exercise handgrip assembly according to claim 4 wherein the retention channel and the tethering window are disposed in communicative alignment with one another.

8. The adjustable exercise handgrip assembly according to claim 4 wherein the tether retention configuration of the handgrip's tether retention channel comprises a narrowed sector.

* * * * *